US005855298A

United States Patent [19]

Teetsel, III et al.

[11] Patent Number: 5,855,298

[45] Date of Patent: Jan. 5, 1999

[54] TAPPING STEM FOR LIQUID SUPPLY CONTAINER

[75] Inventors: Charles F. Teetsel, III; Timothy J. Horwath, both of Phoenix, Ariz.

[73] Assignee: Creamiser Products Corporation, Phoenix, Ariz.

[21] Appl. No.: 811,135

[22] Filed: Mar. 3, 1997

Related U.S. Application Data

[63] Continuation of Ser. No. 292,732, Aug. 18, 1994, abandoned.

[51] Int. Cl.[6] ..... B67D 5/06

[52] U.S. Cl. ..... 222/81; 222/88

[58] Field of Search ..... 222/81, 82, 83, 222/88; 141/330

[56] References Cited

U.S. PATENT DOCUMENTS

| | | | |
|---|---|---|---|
| 1,465,617 | 8/1923 | Shatz | 222/81 |
| 1,538,273 | 5/1925 | Darrow . | |
| 2,245,698 | 6/1941 | Miller . | |
| 2,453,133 | 11/1948 | Jones . | |
| 2,552,155 | 5/1951 | Danielson . | |
| 2,585,538 | 2/1952 | Daniels . | |
| 2,655,286 | 10/1953 | Barbaro | 222/88 X |
| 2,751,119 | 6/1956 | Manning . | |
| 3,239,104 | 3/1966 | Scholle | 22/88 X |
| 3,902,652 | 9/1975 | Malcolm . | |
| 3,970,121 | 7/1976 | Brandt | 141/330 X |
| 4,040,389 | 8/1977 | Walters | 222/81 X |
| 4,341,328 | 7/1982 | Redick, Jr. | 222/83.5 |
| 4,557,399 | 12/1985 | Redick, Jr. | 222/83.5 |
| 4,801,007 | 1/1989 | Rule | 222/81 X |
| 4,881,662 | 11/1989 | Tallman | 222/81 |
| 5,303,732 | 4/1994 | Jonsson | 222/83 X |
| 5,325,995 | 7/1994 | Harrison et al. | 222/81 |

FOREIGN PATENT DOCUMENTS

| | | | |
|---|---|---|---|
| 2410773 | 9/1975 | Germany | 222/88 |
| 923527 | 4/1963 | United Kingdom | 222/82 |

OTHER PUBLICATIONS

APW/Wyott, "Classic Creamers Eutectic (Ice) Cooled" Product Materials for Models DB0, DA0, Aug. 1992.

American Wyott Corporation, "Classic Creamers—Refrigerated Specification Sheet DD–01–20," Product Materials, 1989.

Server Products, Inc., "Cream Server" Product Materials for CSM #94000, undated.

Progressive Corporation, "Operating Instructions and Service Manual" for Ther–a–Creamer Models TC–3/TC–6, 1970.

Carpigiani, s.r.l., "Easywip" Product Materials, printed in Italy, Oct. 1992.

*Primary Examiner*—Kenneth Bomberg
*Attorney, Agent, or Firm*—Richard E. Oney

[57] ABSTRACT

A tapping stem is used with a liquid dispenser for dispensing liquid from a disposable liquid container. The stem has a generally elongated body including a piercing end, a discharge end and a peripheral flange affixed to the discharge end. The piercing end has a generally cylindrical portion and an adjacent tapered portion terminating in a sharp tip for piercing the wall of the container. The stem body includes an intake passage and a discharge passage aligned along generally separate, parallel axes and dimensioned to intersect each other. The intake passage forms a channel in the piercing end, which channel extends substantially to the tip.

21 Claims, 4 Drawing Sheets

FIG. 1
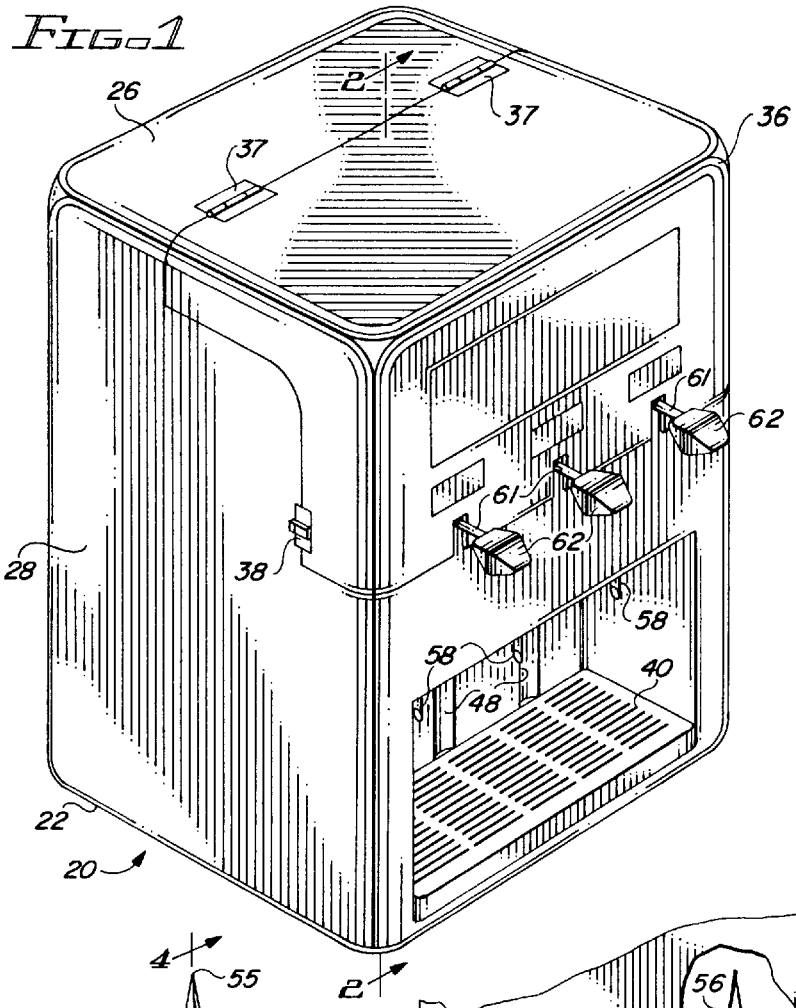
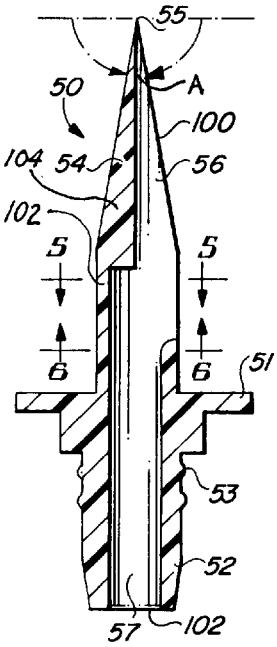
FIG. 4
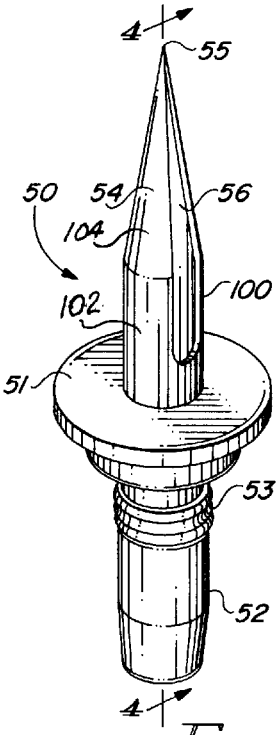
FIG. 3
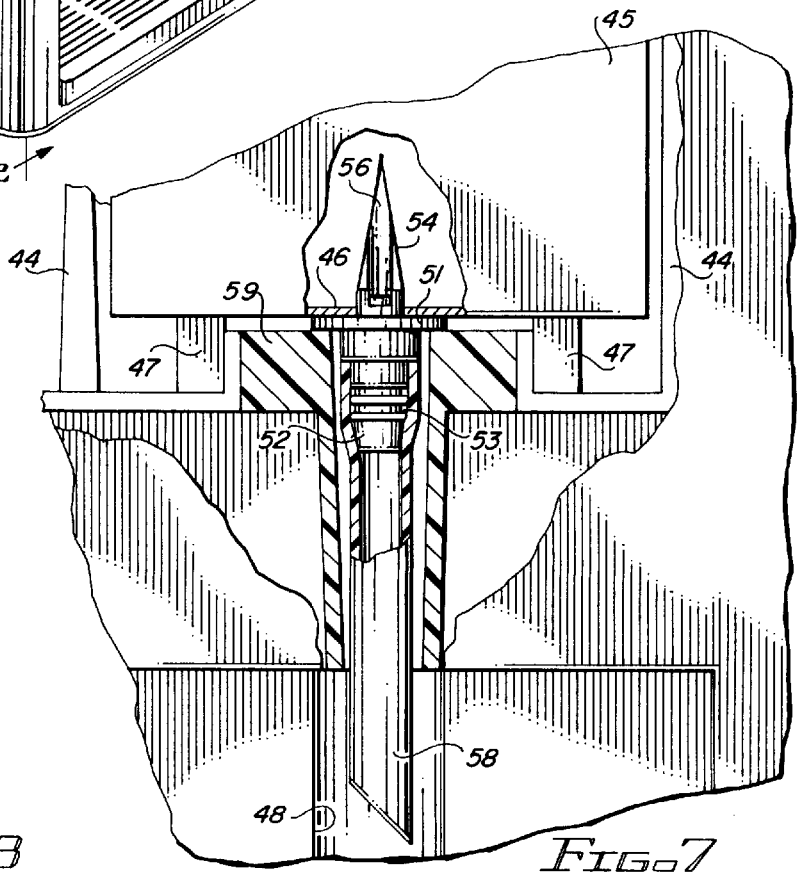
FIG. 7

FIG. 12
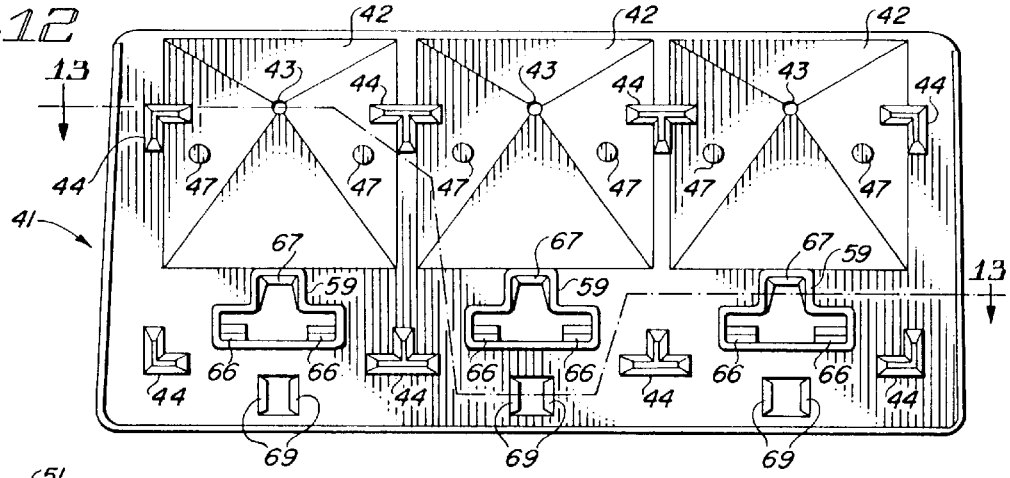
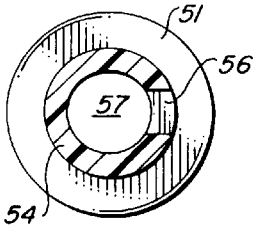
FIG. 5
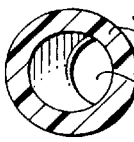
FIG. 6
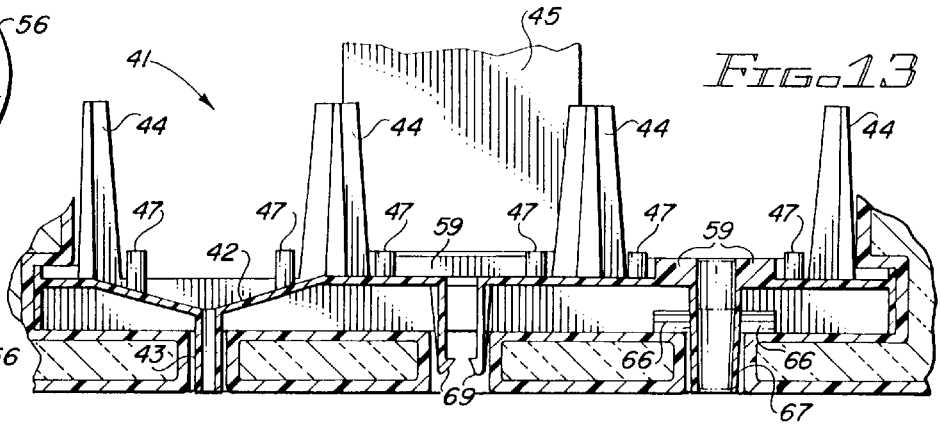
FIG. 13

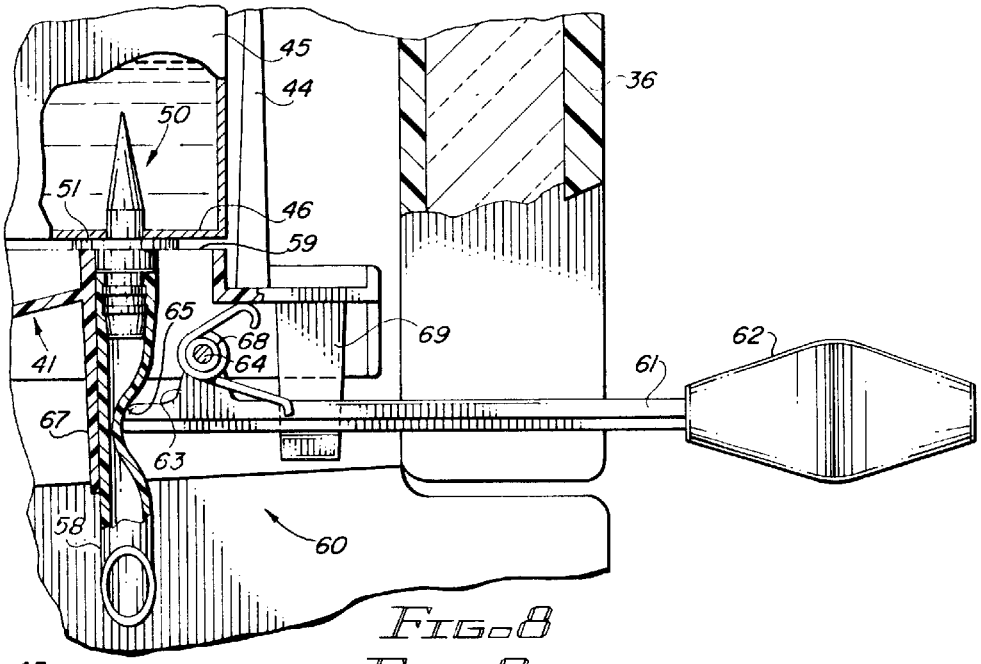
FIG. 8
FIG. 9
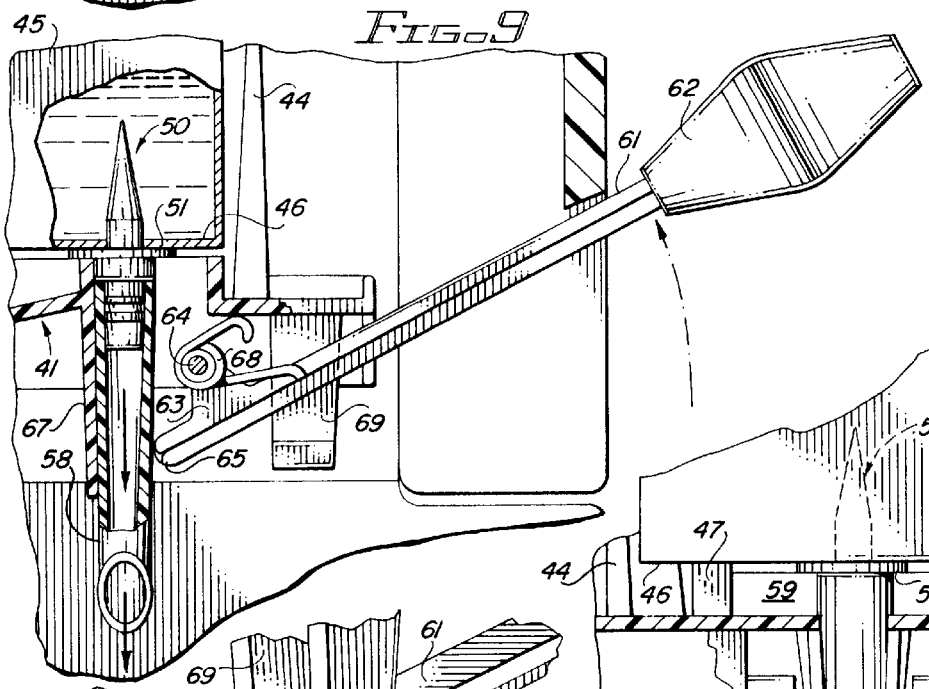
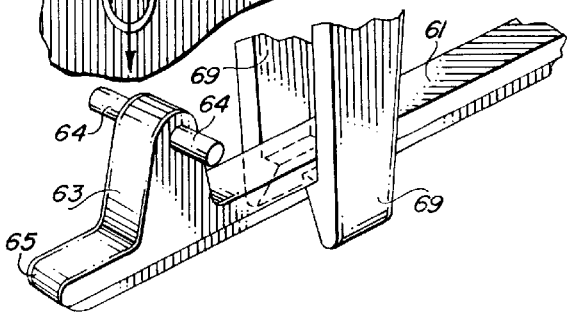
FIG. 11
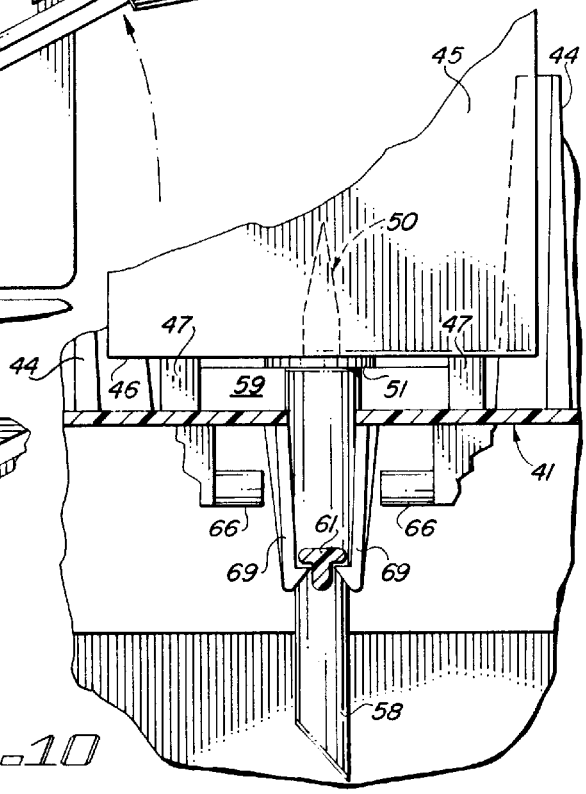
FIG. 10

TAPPING STEM FOR LIQUID SUPPLY CONTAINER

This is a continuation of application Ser. No. 08/292,732, filed Aug. 18, 1994, now abandoned.

BACKGROUND

This invention relates to liquid dispensers. More particularly, it relates to a liquid dispenser having a tapping stem for communicating with the interior of a disposable liquid container, such as a wax paper carton of the type conventionally used for packaging dairy products, and utilizing the container as the only reservoir for storing the liquid to be dispensed.

Liquid dispensers are well-known in food service applications. One example of such a liquid dispenser is a cream dispenser. Typically, cream dispensers include a housing, which supports a removable reservoir for holding the cream to be dispensed, and a valve assembly for dispensing the cream. Generally, the housing and reservoir are made of stainless steel or other durable material, and the housing is usually provided with suitable thermal insulation. The cream stored in the reservoir is cooled in the dispenser either by a mechanical refrigeration system or by a eutectic refreezable device.

These existing cream dispensers have a number of disadvantages. The stainless steel components of such cream dispensers are relatively expensive to manufacture. To use such cream dispensers, one must fill the reservoir from the carton or other container in which the cream is packaged. Cleaning of the dispenser, which must be performed on a regular schedule, requires removal and cleaning of the reservoir and the valve assembly. Moreover, a food service establishment desiring to serve cream from multiple reservoirs (for example, where the establishment desires to provide several different flavors of cream at one time) must use multiple of these dispensers. This requires significant counter space for the dispensers and correspondingly places increased cleaning demands on the establishment.

There is a need, therefore for a cream dispenser that is relatively inexpensive to manufacture, that is convenient to use and easier to clean than present dispensers having storage reservoirs which require cleaning and that is relatively compact in size and can dispense cream from multiple storage containers at one time.

SUMMARY

In accordance with our invention, these needs, among others, are met by providing a liquid dispenser of the character described in the first paragraph above. In one aspect of the invention, the liquid dispenser has valve means for regulating the flow of liquid from the dispenser, support means for holding the container in a loaded position generally elevated above the valve means, and a tapping stem for communicating the interior of the container with the valve means absent any liquid storage reservoir other than the container. The support means includes means for enabling placement of the container into the loaded position and removal of the container from the loaded position. The stem includes a generally elongated body having a piercing end, a discharge end and sealing means for sealingly engaging the container. The stem piercing end includes piercing means for piercing a wall of the container, and the stem body includes a passage extending from an intake opening in the piercing end to a discharge opening in the discharge end, with the discharge opening being in communication with the valve means. The dispenser also includes means for holding the stem in a fixed position so that when the container is moved into the loaded position the piercing end of the stem penetrates into the interior of the container and the sealing means forms a sealed relationship with the container, thereby enabling gravity flow of liquid from the container to the valve means absent any liquid storage device other than the container.

In a preferred embodiment of the invention, the piercing means includes a sharp tip on the piercing end of the stem, the tip having a generally conical shape and forming an angle of approximately 20 degrees. The stem is composed of rigid thermoplastic. For ease of manufacture by molding, the passage in the tapping stem includes an intake passage and a discharge passage alligned generally along separate parallel axes and dimensioned to intersect each other. The intake passage and the discharge passage are generally cylindrical bores. The intake passage can be a channel in the piercing end. Preferably, the sealing means for sealingly engaging the wall of the container includes a peripheral flange affixed to the discharge end of the body. Optionally, but not necessarily, the sealing means can include a peripheral rib on the flange and a compressible washer on the flange. Also optionally and to provide better draining of the liquid from the bottom of the container, the intake opening in the piercing end of the stem can be positioned such that when the stem is inserted into the wall of the container, the wall intersects a portion of the intake opening and no portion of the intake opening is exposed to the exterior of the container.

The support means of the dispenser can include a housing having a generally horizontal shelf for supporting a platform having means for vertically slidably receiving the container into the loaded position, at least one upwardly projecting container pedestal for contacting a bottom wall of the container when the container is in the loaded position, and an upwardly projecting stem pedestal having an opening therein for receiving the stem with the piercing end upward so that when the container is moved into the loaded position the piercing means penetrates into the interior of the container and the sealing means forms a sealed relationship with the container. Preferably, the platform includes a catch basin having an inclined or slanted bottom providing a low drain point and a drain spout positioned therein for diverting liquid caught in the catch basin away from the platform. Also it is preferable that the support means includes means for removably receiving the platform so that the platform can be removed for cleaning.

The valve means can include a flexible tube in communication with the discharge opening of the stem, a rigid tube seat projecting downward from the platform for loosely receiving the tube, a valve actuator generally in the shape of a lever arm having a handle end and a gate end for compressing the tube against the tube seat to restrict flow of liquid therethrough when the actuator is in a closed position, and valve support means for rotatably supporting the valve actuator and providing a fulcrum about which the valve actuator can rotate from the closed position to an open position, and means for holding the valve actuator in the closed position and allowing the actuator to be rotated to the open position in response to an external force. The means for holding the valve actuator preferaby can include a retainer clip member projecting from the platform. The valve support means supports the valve actuator in spaced relation to the tube and the tube seat so that the gate end of the valve actuator compresses the tube against the tube seat when the valve actuator is in the closed position, thereby restricting flow of liquid through the tube.

BRIEF DESCRIPTION OF THE DRAWINGS

These and other features, objects and advantages of the invention will be more fully understood from the following more detailed description, appended claims, and accompanying drawings, in which:

FIG. 1 is a perspective view of a liquid dispenser that embodies features of our invention.

FIG. 3 is a perspective view of a tapping stem, in accordance with our invention, for piercing and communicating with the liquid supply container.

FIG. 4 is a sectional view of the stem of FIG. 3, taken through line 4—4 of FIG. 3.

FIG. 5 is a sectional view of the stem of FIG. 3 taken through line 5—5 of FIG. 4.

FIG. 6 is a sectional view of the stem of FIG. 3 taken through line 6—6 of FIG. 4.

FIG. 7 is a partial front sectional view taken through line 7—7 of FIG. 2 showing, on an enlarged scale, a liquid supply container in the loaded position in the dispenser and the interrelationship of the container and the stem, the platform and the tube.

FIG. 8 is an enlarged detail of a portion of FIG. 2, including that portion within the area enclosed within line 8 of FIG. 2, showing the valve actuator in the closed position restricting the flow of liquid from the supply container.

FIG. 9 is an enlarged detail of a portion of FIG. 2, including that portion within the area enclosed within line 8 of FIG. 2, showing movement of the valve actuator to the open position to enable the flow of liquid from the supply container.

FIG. 10 is a partial cross-sectional front view of the detail of the liquid dispenser on an enlarged scale, taken along line 10—10 of FIG. 2.

FIG. 11 is a perspective detail view showing the relationship of the valve actuator and the retainer clip members when the valve is in the closed position.

FIG. 12 is a top view of the platform configured for receiving three of the containers simultaneously.

FIG. 13 is a cross-sectional front view of the platform taken along line 13—13 of FIG. 12, showing the platform in position on top of the support shelf.

DESCRIPTION

Figure 2:
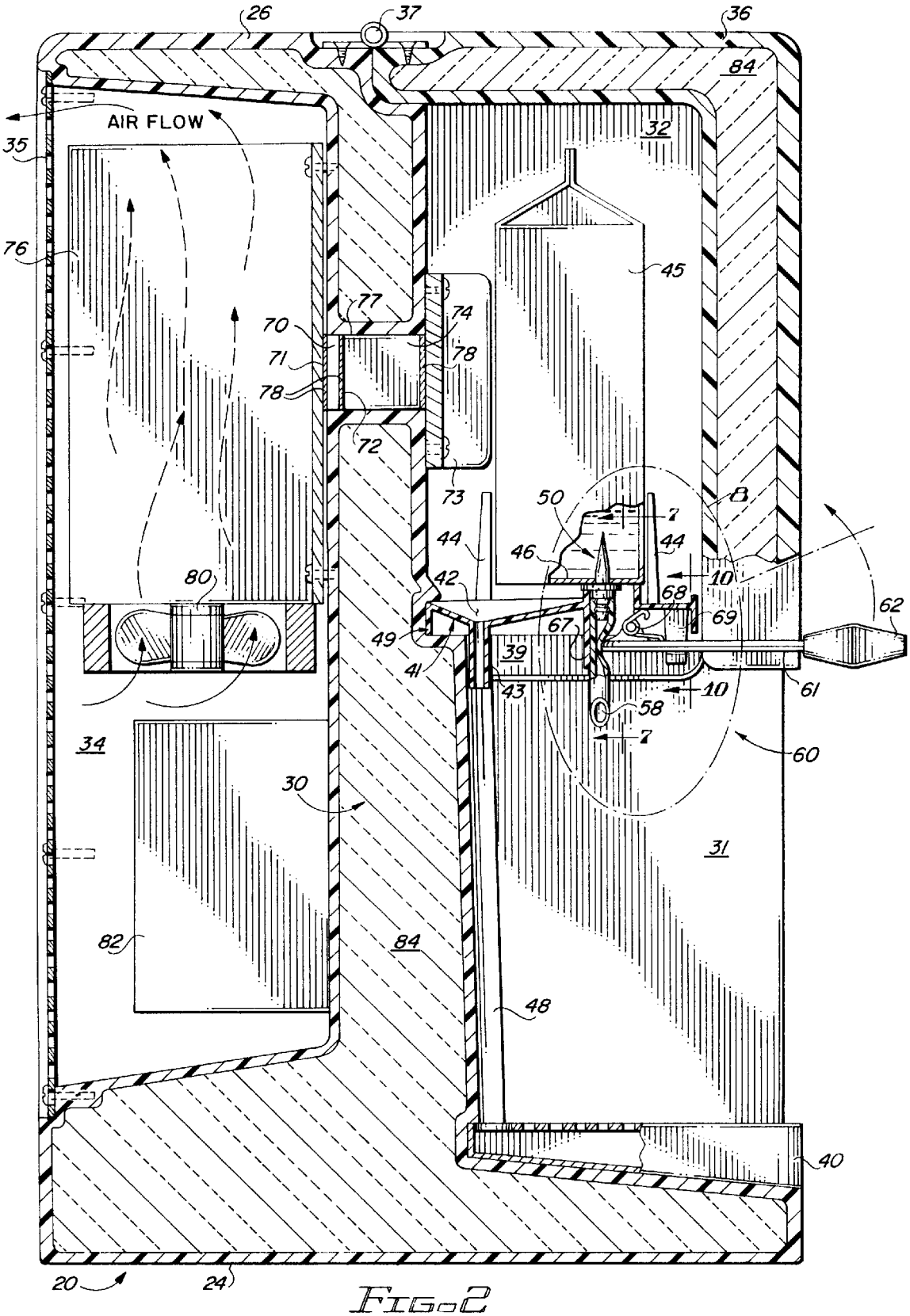
FIG. 2 is a partial sectional side view taken through line 2—2 of FIG. 1 showing the relationship of the components of the liquid dispenser of FIG. 1 and the liquid supply container.

In accordance with our invention, FIGS. 1 and 2 show a preferred embodiment of a liquid dispenser 20 including a housing 22 having a base 24, a top 26 and two generally vertical opposing side walls 28. A generally vertical partition 30, located approximately midway between the front and rear of the housing 22, extends transversally between the side walls 28. A generally horizontal support shelf 39 extends forward from the partition 30. In this configuration, the housing 22 defines a rear compartment 34 having an opening in the back of the housing 22, a liquid storage compartment 32 located in the upper portion of the housing above the shelf 39 opening generally toward the top and front of the housing 22, and a recess 31 located in the lower portion of the housing 22 below the shelf 39 opening toward the front of the housing 22.

The housing 22 includes a removable vented panel 35, which covers the rear compartment 34. A removable drip tray 40 is located in the base 24 in the bottom of the recess 31. The housing 22 also includes a cover 36 adapted to closely fit the opening of the storage compartment 32 and rotatably attached to the housing top 26 by hinges 37. In this configuration, the storage compartment 32 is fully enclosed when the cover 36 is in the lowered, closed position. Access to the storage compartment 32 can be obtained by lifting the front of the cover 36 thereby rotating the cover 36 on the hinges 37 into an open position. A latch 38 is adapted to latch the cover 36 in the closed position.

The housing 22 is formed so that the base 24, the top 26, the cover 36, the partition 30 and the support shelf 39 are hollow. Such a construction can be achieved by using a rotational molding process to form the housing 22, preferably from thermoplastic material such as polyethylene. When so constructed, the interior of the housing can be filled with thermal insulating material 84, such as a spray foam insulating material.

A removable platform 41 is positioned on top of the support shelf 39. A generally horizontal channel 49 is in the partition 30 and the side walls 28 adjacent the support shelf 39 for slidingly receiving the rear edge of the platform 41 and restricting the platform from upward movement. The platform 41 includes a catch basin 42 having an inclined or slanted bottom providing a low drain point and a drain spout 43 which is in overlying relation to a vertical drain channel 48 in the surface of the partition 30 and to the drip tray 40. The platform 41 also includes a plurality of vertical guides 44 adapted to vertically slidably receive a liquid supply container 45 into a loaded position. The platform 41 includes at least one upwardly projecting container pedestal 47 for contacting a container bottom wall 46 when the container 45 is in the loaded position, and an upwardly projecting stem pedestal 59 located generally near the forward portion of the platform 41. In a preferable embodiment, the platform 41 is composed of injection molded thermoplastic.

A tapping stem 50 having a generally elongated body is removably received in an opening in the stem pedestal 59. Referring to FIGS. 3 through 6, a preferred embodiment of the stem 50 includes a discharge end 52 optionally provided with one or more raised seal rings 53 on the exterior thereof, a piercing end 54 having a generally cylindrical portion 102 adjacent to a generally tapered portion 104 terminating in a sharp tip 55, and a peripheral flange 51 affixed to the discharge end 52 of the stem 50 and adjacent to the cylindrical portion 102. As shown in FIGS. 4 and 6, the cylindrical portion 102 has a cross-sectional diameter that is substantially equal to or greater than the cross-sectional diameter of the tapered portion 104 at any point along the its length. The stem 50 has a passage therethrough including an intake passage 56, having an intake opening 100 in the piercing end 54 between the tip 55 and the flange 51, and a discharge passage 57 having a discharge opening 102 in the discharge end 52. Preferably, the intake passage 56 and the discharge passage 57 are axial bores alligned along separate, generally parallel axes and are dimensioned to intersect each other to allow for ease of manufacture, as discussed below. In this configuration, the intake passage 56 preferably intersects the surface of the piercing end 54 along the length of the intake passage 56 whereby the intake passage 54 forms a channel in the piercing end, which channel extends substantially to the tip 55, and the intake opening 100 is slotted. The tip 55 a has a generally conical shape forming an angle A selected so that the tip 55 is sharp enough to effectively puncture the container 45 without excessively ripping it but is not so sharp as break easily. For puncturing wax paper dairy cartons the angle A is preferably approximately 20 degrees.

When the stem 50 is positioned in the platform 41, the flange 51 rests against the stem pedestal 59 and the discharge end 52 extends below the support shelf 39 for receiving the upper end of a flexible tube 58 in a manner which communicates the interior of the tube 58 with the interior of the stem 50. When the container 45 is positioned within the guides 44 and moved downwardly into contacting relation with the container pedestals 47, the stem tip 55 will pierce the container bottom wall 46 and the piercing end 54 will penetrate through the container bottom wall 46, thus communicating the interior of the container 45 with the interior of the stem 50 and the interior of the tube 58. The stem 50 is formed of material suitable for puncturing the container 45. In a preferred embodiment, the stem 50, including the tip 55, is composed entirely of rigid thermoplastic material such as polycarbonate. Such a stem 50 having the structure described in the preceding paragraph will effectively puncture and form a sealing engagement with containers 45 constructed of wax paper material, such as the well-known gabled dairy carton.

Referring to FIGS. 2 and 9, the dispenser includes a valve 60 as means for controlling the discharge of liquid from the container 45. A rigid tube seat 67 projects downward from the platform 41 for loosely receiving tube 58. The valve 60 includes a valve actuator 61 generally in the shape of a lever arm, with a handle end 62 and a gate end 65 for compressing the flexible tube 58 to control flow of liquid therethrough. Near the gate end 65, a generally perpendicular projecting member 63 affixed to the actuator 61 supports hinge pins 64 in a generally perpendicular orientation to the valve actuator 61 and the projecting member 63. As shown in detail in FIGS. 8 through 13, the platform 41 includes two downward-projecting valve supports 66 adapted to receive the pins 64 so as to support the valve actuator 61 and provide a fulcrum about which the valve actuator 61 can rotate when the handle end 62 is lifted upward. In addition, the platform 41 includes two downward-projecting, L-shaped, opposing retaining clip members 69 which form a retaining clip for restricting the valve actuator 61 from rotating downward to a position generally below horizontal while permitting upward movement of the handle end 62. The valve supports 66 are positioned so that the gate end 65 will compress the flexible tube 58 against the tube seat 67 when the valve actuator 61 is in a generally horizontal position. A coil spring 68 is positioned over one of the pins 64 and is selected to provide suitable torque on the valve actuator 61 to force it downward against the retaining clip members 69. The retaining clip members 69 restrict the valve actuator 61 from rotating downward beyond a generally horizontal position, which would result in leakage of liquid through the tube 58.

Referring again to FIGS. 1, 12 and 13, a preferred embodiment of the dispenser is adapted to dispense liquid from a plurality of containers 45 at one time. In this embodiment, the storage compartment 32 is sized to accomodate the plurality of containers 45. A plurality of drain channels 48 are provided and the platform 41 is adapted for use with a plurality of stems 50, stem pedestals 59, valves 60 (including a plurality of tubes 58, tube seats 67, valve supports 66, and retaining clip members 69), catch basins 42, drain spouts 43, and guides 44 for providing the structure disclosed above for each of the plurality of containers 45.

Referring again to FIG. 2, temperature control of the storage compartment 32 is provided by means including a thermoelectric module 70 adapted to enable transfer of thermal energy between the storage compartment 32 and the external environment of the liquid dispenser 20. A cold plate 73 is mounted inside the storage compartment 32 on the partition 30, and a heat sink 76 is mounted inside the rear compartment 34 on the partition 30. The cold plate 73 is positioned in overlying relation to the catch basin 42 for collecting condensation from the cold plate. A hot side 71 of the thermoelectric module 70 is thermally coupled to the heat sink 76, and a cold side 72 of the thermoelectric module 70 is thermally coupled to a thermal transfer block 74, which is closely positioned within a shaft 77 extending through the partition 30 and is also thermally coupled to the cold plate 73. The cold plate 73, the thermal transfer block 74, and the heat sink 76 are composed of material having suitable thermal conductivity, preferably aluminum or copper. Thermal coupling of these elements is enhanced by applying a thermally conductive medium 78, such as thermal epoxy, thermal grease or thermal pads between the surfaces of the elements where they interface each other and the thermoelectric module 70.

A fan 80 is mounted in the rear compartment 34 adjacent the heat sink 76 and is adapted to move air over the heat sink 76. A power supply 82 provides electric power to operate the fan 80 and the thermoelectric module 70. In this configuration, the temperature of the storage compartment 32 can be controlled by regulating the power to the thermoelectric module 70 using conventional means, preferably a thermistor mounted in the cold plate 73, a feedback loop and power supply control circuitry. Temperature control of the storage compartment 32 is improved by providing thermal insulation 84 in the interior of the base 24, the top 26, the cover 36, the partition 30, and the support shelf 39 of the housing 22, as discussed above. In a preferred configuration, the desired temperature control is achieved with only one thermoelectric module 70. Alternatively, multiple thermoelectric modules 70 can be used for improved thermal transfer capacity.

In operation, a container of liquid 45 is loaded into the dispenser by positioning the container 45 within the guides 44 and moving it downward into contacting relation with the container pedestals 47 of the platform 41. When so loaded, the stem tip 55 will pierce the bottom surface 46 of the container 45 and the piercing end 54 will penetrate into the container, thereby communicating the interior of the container 45 with the interior of the stem 50 and the interior of the tube 58. The downward force exerted on the filled supply container 45 must be sufficient to cause the stem tip 55 to penetrate the container bottom surface 46. After the container 45 is placed in this loaded position, the upper end of the container 45 is opened or punctured to allow entry of air into the container 45 to enable the liquid to flow freely when dispensed.

Referring to FIGS. 8 and 9, liquid is dispensed from the container 45 and out of the tube 58 by lifting the handle end 62, thereby raising the valve actuator 61 above a generally horizontal position and causing the gate end 65 to rotate away from and release the pressure on the tube 58, thereby allowing gravitational flow of liquid from the container 45 through the stem 50 and the tube 58. When the handle end 62 is released, the spring 68, and the weight of the valve handle end 62 and the actuator 61, cause the actuator 61 to return to the horizontal position as shown in FIG. 8, thereby causing the gate end 65 to compress the tube 58 against the tube seat 67 and restrict the flow of liquid. When the container 45 is empty, it can be removed by vertically lifting the handle end 62 and removing the container 45, along with the stem 50 and the tube 58 attached thereto, from the platform 41. Any leakage of liquid from the container 45 when it is removed will drain into the catch basin 42, through the drain spout 43 and into the drip tray 40. The empty container 45 can be disposed of after it is removed from the dispenser and replaced with a new full container after replacement of the stem 50 and the tube 58.

To facilitate cleaning of the dispenser, the platform 41, the stem 50, the tube 58 and the valve assembly 60 may be removed from the housing 22 and disassembled. For convenience, the stem 50 and the tube 58 may be disposed of, rather than cleaned, and replaced with a new stem and tube. After repeated uses, depending on the hardness of the material comprising the stem 50 and the nature of the container 45, the stem generally will have to be replaced or sharpened, if appropriate, as the tip 55 becomes dull.

Experimental prototypes of the preferred embodiment of the tapping stem 50 shown in FIGS. 3 and 4 have been made from plastic and aluminum and used to pierce and sealingly engage wax paper dairy cartons. The prototype stem 50 is approximately 1 11/16 inches long, with the distance from the flange 51 to the tip 55 being approximately 31/32 inch. The flange 51 is circular and has a diameter of approximately ¾ inch. The piercing end 54 terminates in a conically shaped tip and the angle A is approximately 20 degrees. The diameter of each of the intake passage 56 and the discharge passage 57 are approximately 5/32 inch and their axes are offset by approximately 3/32 inch. The diameter of the piercing end 54 adjacent the flange 51 is approximately ¾ inch.

The above described structure possesses several advantages. It is convenient to use and clean because, among other reasons, the liquid dispenser can utilize conventional disposable containers without any additional storage reservoir, and the platform 41, the stem 50, and the valve 60 (including the tube 58) can be easily dissasembled for cleaning and the stem and tube can be disposable. Generally, only the container 45, the stem 50, and the tube 58, all of which can be disposable, come into extensive contact with the liquid, thereby reducing cleaning and maintenance requirements. The dispenser can be constructed of relatively inexpensive materials. In addition, the preferred embodiment of the stem 50 shown in FIGS. 3 and 4 can be manufactured by injection molding using an open-and-shut mold without the necessity of using intersecting slides in the mold. As is readily apparent, this results in a stem body, including a tip, that is an integral unit. This results in less expensive mold tooling, longer life expectancy of the tooling, and shorter cycle time for molding of the stem than would be the case if an intersecting slide were necessary. Moreover, the disclosed dispenser structure is compact in size and can dispense liquid from multiple containers at one time.

Although our invention has been described in considerable detail with reference to certain preferred emodiments thereof, it will be apparent to those of ordinary skill in the art that various modifications and adaptations to those embodiments are possible. Therefore, the spirit and scope of the appended claims should not necessarily be limited to the exact construction and operation shown and described, and accordingly, all suitable modifications and equivalents may be resorted to, falling within the scope of the invention.

We claim:

1. A tapping stem for piercing a wall of a disposable liquid supply container and communicating with the interior of the container, the stem comprising:

a generally elongated body having a piercing end and a discharge end, the piercing end having a generally cylindrical portion adjacent to a generally conical portion terminating in a sharp tip for piercing the wall of the container;

the conical portion of the piercing end having a largest cross-section that is substantially equal to a parallel cross-section of the cylindrical portion;

a peripheral flange affixed to the discharge end of the stem body and adjacent to the cylindrical portion of the piercing end;

the discharge end being adapted for sealing receiving a flexible tube;

the stem body including an intake passage having an intake opening in the piercing end proximal to the flange and a discharge passage having a discharge opening in the discharge end; and the intake passage and the discharge passage being aligned generally along separate parallel axes and being dimensioned to intersect each other;

whereby the interior of the container is placed in communication with the discharge opening when the piercing end is inserted through the wall of the container.

2. The tapping stem of claim 1 wherein the intake passage comprises a channel in the piercing end of the tapping stem.

3. The tapping stem of claim 2 wherein the channel extends substantially to the tip of the tapping stem.

4. The tapping stem of claim 1 wherein the tip is integral with the piercing end of the stem body.

5. The tapping stem of claim 1 wherein the stem body is an integral unit.

6. The tapping stem of claim 1 wherein the stem is composed entirely of rigid plastic material.

7. The tapping stem of claim 1 further comprising a compressible washer disposed on the flange.

8. A tapping stem for piercing a wall of a disposable liquid supply container and communicating with the interior of the container, the stem comprising:

a generally elongated body having a discharge end for sealingling receiving a flexible tube and a piercing end having a generally conical portion terminating in a sharp tip for piercing the wall of the container;

a peripheral flange affixed to the discharge end of the stem body;

the piercing end having a largest cross-section at a point adjacent the flange, the largest cross-section being substantially equal to or larger than any other cross-section along the length of the piercing end;

the piercing end having a substantially smooth taper from the flange to the sharp tip;

the stem body including an intake passage having an intake opening in the piercing end proximal to the flange and a discharge passage having a discharge opening in the discharge end; and the intake passage and the discharge passage being aligned generally along separate parallel axes and being dimensioned to intersect each other;

whereby the interior of the container is placed in communication with the discharge opening when the piercing end is inserted through the wall of the container.

9. The tapping stem of claim 8 wherein the intake passage comprises a channel in the piercing end of the tapping stem.

10. The tapping stem of claim 9 wherein the channel extends substantially to the tip of the tapping stem.

11. The tapping stem of claim 8 wherein the tip is integral with the piercing end of the stem body.

12. The tapping stem of claim 8 wherein the stem body is an integral unit.

13. The tapping stem of claim 8 wherein the stem is composed entirely of rigid plastic material.

14. The tapping stem of claim 38 further comprising a compressible washer disposed on the flange.

15. A tapping stem for piercing a wall of a disposable liquid supply container and communicating with the interior of the container, the stem comprising:

a generally elongated body having a discharge end and a piercing end having a substantially conical portion terminating in a sharp tip for piercing the wall of the container;

sealing means disposed on the discharge end for sealingly engaging the wall of the container when the piercing end is inserted through the wall of the container so that the piercing end is in the interior of the container and the discharge end is not in the interior of the container;

the piercing end having a largest cross-section at a point adjacent the sealing means, the largest cross-section being substantially equal to or larger than any other cross-section along the length of the piercing end;

the discharge end being adapted for sealingly receiving a flexible tube;

the stem body including an intake passage having an intake opening in the piercing end proximal to the sealing means and a discharge passage having a discharge opening in the discharge end; and the intake passage and the discharge passage being aligned generally along separate parallel axes and being dimensioned to intersect each other;

whereby the interior of the container is placed in communication with the discharge opening when the piercing end is inserted through the wall of the container.

16. The tapping stem of claim 15 wherein the intake passage comprises a channel in the piercing end of the tapping stem.

17. The tapping stem of claim 15 wherein the sealing means includes a flange affixed to the discharge end of the stem body.

18. The tapping stem of claim 15 wherein the tip is integral with the piercing end of the stem body.

19. The tapping stem of claim 15 wherein the stem body is an integral unit.

20. The tapping stem of claim 15 wherein the stem is composed entirely of rigid plastic material.

21. The tapping stem of claim 15 wherein the sealing means for sealingly engaging the wall of the container comprises a compressible washer disposed on a flange affixed to the discharge end of the stem body.

* * * * *